US006876301B1

(12) United States Patent
Ray et al.

(10) Patent No.: US 6,876,301 B1
(45) Date of Patent: Apr. 5, 2005

(54) NON-RIGID CARD HOLDER WITH ALARM SYSTEM

(76) Inventors: Coleman Ray, 1580 E. Sandpiper Cir., Pembroke Pines, FL (US) 33026; Cruise P. Berrio, 4939 SW. 135$^{th}$ Ct., Miami, FL (US) 33075

( * ) Notice: Subject to any disclaimer, the term of this patent is extended or adjusted under 35 U.S.C. 154(b) by 0 days.

(21) Appl. No.: 10/384,480

(22) Filed: Mar. 7, 2003

Related U.S. Application Data

(63) Continuation-in-part of application No. 10/063,965, filed on May 30, 2002, now abandoned.

(51) Int. Cl.$^{7}$ ..... G08B 13/14
(52) U.S. Cl. ..... 340/571; 340/568.1; 340/568.7
(58) Field of Search ..... 340/568.1, 568.7, 340/531, 571; 200/61.19; 362/154, 200

(56) References Cited

U.S. PATENT DOCUMENTS

| | | | | | |
|---|---|---|---|---|---|
| 4,652,865 | A | * | 3/1987 | Maharshak | 340/568.7 |
| 4,692,745 | A | | 9/1987 | Simanowitz | 340/568.7 |
| 4,719,453 | A | | 1/1988 | Beck et al. | 340/568.7 |
| 4,890,094 | A | | 12/1989 | Kopel | 340/568.7 |
| 4,916,434 | A | | 4/1990 | McNeely | 340/568.7 |
| 5,034,724 | A | | 7/1991 | Tone | 340/571 |
| 5,373,283 | A | | 12/1994 | Maharshak | 340/568.7 |
| 5,412,372 | A | * | 5/1995 | Parkhurst et al. | 340/568.1 |
| 5,418,520 | A | | 5/1995 | Hirshberg | 340/568.7 |
| 5,515,031 | A | * | 5/1996 | Pereira et al. | 340/693.3 |
| 5,642,095 | A | | 6/1997 | Cook | 340/568.7 |
| 5,790,027 | A | * | 8/1998 | Chern | 340/568.7 |
| 5,892,444 | A | * | 4/1999 | Wittmer et al. | 340/571 |
| 6,089,289 | A | * | 7/2000 | Florjancic | 150/147 |
| 6,184,788 | B1 | | 2/2001 | Middlemiss et al. | 340/568.7 |
| 6,409,360 | B2 | * | 6/2002 | Contant | 362/154 |
| 6,560,335 | B2 | * | 5/2003 | Zohn et al. | 379/452 |

* cited by examiner

*Primary Examiner*—Van T. Trieu
(74) *Attorney, Agent, or Firm*—Malin, Haley & DiMaggio, P.A.

(57) ABSTRACT

The present invention is a flexible non-bulky, metal-minimizing card holder for credit cards, debit cards and identification cards, including an alarm for identifying removal of a card from a holder after a predetermined duration using flexible contact points, comprising a holder for a card; non-rigid flexible electrical contact means located in the interior of the holder for triggering an alarm adapted to be held apart by a card in the holder; an intrinsic power source and an audible alarm after a predetermined delay after removal of the card from the holder.

24 Claims, 2 Drawing Sheets

NON-RIGID CARD HOLDER WITH ALARM SYSTEM

This application is a continuation-in-part of application Ser. No. 10/063,965, filed May 30, 2002 now abandoned.

FIELD OF INVENTION

This invention relates to a card holder in general, and more specifically to mechanism that holds a card and sounds an alarm when a card has been removed from a holder for a predetermined period of time.

BACKGROUND OF THE INVENTION

Credit and debit cards are widely used in purchasing goods and services in society today. Their use is pervasive as people can use them at a variety of locations, practically obviating the need to carry cash. Unfortunately, sometimes a card owner will inadvertently leave a credit card or other important card in a store or similar place. If an owner has several cards and carries them often, the loss may remain unnoticed for a considerable time. The longer the time such a mistake remains unnoticed, the harder it is to recall exactly where the card may have been left. The headache and waste of time suffered by the owner in replacing these cards can be a severe nuisance. Moreover, unauthorized persons may then have access to the card and run up charges or run down accounts on the card.

Likewise, a lost identification card can be difficult and expensive to replace when it is lost. Many identification cards are approximately the size and shape of a credit or debit card, and may be protected by means otherwise designed for the protection of credit or debit cards.

Card holders which incorporate alarms are well known in the prior art. U.S. Pat. No. 5,418,520 to Hirshberg discloses a card holder with a power source and a chip programmable to a speak a human voice so that it is less obtrusive than a mechanical alarm. U.S. Pat. No. 4,916,439 to McNeely teaches the use of an electronic system with metallic switch arms and spring clips which are rigid in nature. U.S. Pat. No. 4,692,745 to Simonowitz demonstrates a dual trigger alarm system requiring the opening or closing of a briefcase or outer wallet to trigger the alarm on the card holder. U.S. Pat. No. 4,890,094 to Kopel discloses a bulky accordion-style folding credit card holder that uses dielectric sheets as contacts for the alarm system. U.S. Pat. No. 5,892,444 to Wittmer et al. teaches an alarm system for multiple cards using bulky flexible conductive ribbon to conduct electricity to the alarm. Also, U.S. Pat. No. 5,642,095 to Cook illustrates a complicated alarm system with components remote from the card holder in triggering the alarm. U.S. Pat. No. 6,184,788 to Middlemiss et al. Discloses an electronic system for a hard shell credit card holder with a visible as well as audible alarm that sounds when a card has been taken out. U.S. Pat. No. 5,034,724 to Tone teaches a multi-part alarm system in which the cards are located in a hard plastic holder. Also, U.S. Pat. No. 4,719,453 to Beck et al. discloses a multiple card carrier using metal parts at both the electrical contacts and the flanges. In addition, U.S. Pat. No. 5,373,283 to Maharshak teaches another accordion-style credit card case which incorporates conductor strips in the contacts for triggering the alarm.

These devices all have either bulky mechanisms or require an unnecessary amount of metal in them. Furthermore, these devices have the disadvantage that if the device slips from a person's wallet, then the card as well as the alarm are lost, and the alarm function in the holder is rendered moot.

Thus, a reliable, non-bulky, easy to manufacture credit card holder having an alarm is needed which has a minimum of metallic parts. Not only is such a device more comfortable to wear for the user, but in light of current events, airport security is tight, and carrying unnecessary metal can delay a person's travel.

There is also a need for a credit card holder with an alarm that has a minimum of rigid parts so that unsightly lines are not pressed into a card carrier's clothes when used.

There is also a need for a credit card alarm with conductive gel for contacts to minimize the amount of metal that a person carries and ptrovide a credit card holder that will not slip from a person's wallet.

Accordingly, what is needed in the art is a credit card holder that has non-rigid contacts held apart by the credit card.

What is also needed in the art is a card holder with conductive gel contacts so that the credit card holder will not slip from a person's wallet.

What is also needed in the art is a card holder with conductive silicone gel contacts to minimize the amount of metal within the card holder having an alarm.

It is, therefore, to the effective resolution of the aforementioned problems and shortcomings of the prior art that the present invention is directed.

However, in view of the prior art in at the time the present invention was made, it was not obvious to those of ordinary skill in the pertinent art how the identified needs could be fulfilled.

SUMMARY OF THE INVENTION

The present invention is an apparatus which comprises a flexible non-bulky, metal-minimizing card holder for credit cards, debit cards and identification cards including an alarm for identifying removal of a card from a holder after a predetermined duration using flexible contact points. The invention includes a holder for a card including a recess adapted for holding a card, a non-rigid flexible electrical contact means located in the recess of the holder for triggering an alarm adapted to be held apart by the card in the holder, an intrinsic power source in electronic communication with the contact means, and electronic means for providing an audible alarm after a predetermined delay after the removal of the card from the holder.

Preferably the contact means are made of an electrically conductive high carbon base gel, and are in electronic communication through a line of conductive silicone. Also, it is preferred that the power source is not in electronic communication with the contact means until the alarm has been triggered.

The card holder may be attached to the interior of a wallet. The exterior of the card holder is preferred to be a non-slip silicone case. The exterior of the card holder may be heat sealed to the electronic contact means, or attached to the electronic contact means with an adhesive.

The power source may be inaccessible to the user, or may be accessible to facilitate battery replacement.

The present invention uses a minimum of metal in its construction, has a small, lightweight internal power source, is easy to manufacture, and resists slippage from a person's clothing or wallet.

The present invention is made from materials currently available in the art, and its shape, described herein as generally rectangular, may be of other shapes that do not affect the function of the apparatus.

The power source may be accessible through the non-slip casing, or it may be sealed within the apparatus.

It is therefore an object of the present invention to provide a credit card holder with non-rigid contacts held apart by the credit card.

It is another object of the present invention to provide a credit card holder that will resist slipping from a person's wallet or pants.

It is to be understood that both the foregoing general description and the following detailed description are explanatory and are not restrictive of the invention as claimed. The accompanying drawings, which are incorporated in and constitute part of the specification, illustrate embodiments of the present invention and together with the general description, serve to explain principles of the present invention.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
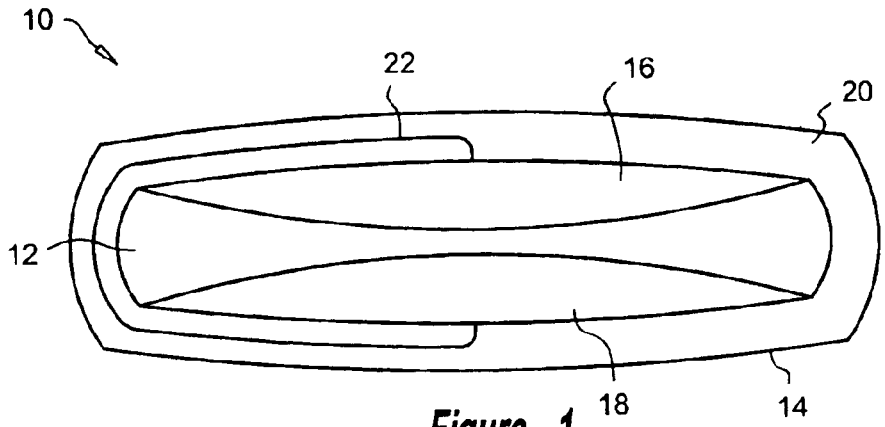
FIG. 1 is a top plan view of the invention.

FIG. 1 shows the inventive credit card holder apparatus including an alarm, shown generally at 10. The apparatus 10 is generally rectangular in shape. It comprises a recess for card holding 12 and an exterior surface 14. It is preferred that the card holding recess 12 comprises a pocket shape 12 within the apparatus 10. The surface of the recess comprises two bowed inwardly biased contacts having a minimum of metal content. Preferably, the apparatus has a top electrically conductive silicone pad 16 and a bottom electrically conductive silicone pad 18. It is preferred that these silicone pads are made from a silicone, high carbon base gel, such as that made by Hitek, Inc. or Sarnoff Corporation, both from Princeton, N.J. The top pad 16 and the bottom pad 18 are situated so that they are in electronic communication for a completed circuit only when there is no card in the recess 12. In the preferred embodiment, the recess 12 is approximately 5.5 centimeters deep and 9 centimeters wide for optimal placement of the card to be inserted in the recess 12. Also, the edges of the top pad 16 and the bottom pad are preferably approximately 1.5 millimeters apart. It is preferred that the apparatus is shaped so that it fits within a typical section for holding a credit card or identification in a typical wallet. However, other dimensions may be used.

The exterior 14 of the apparatus 10 is preferably a flexible silicone case 20 made from a silicone gel. It is preferred that the silicone case 20 have nonskid properties. Thus, if the apparatus is placed in a wallet, then the apparatus will not fall out of the wallet. The top pad 16 and the bottom pad 18 are attached to the silicone case 20 by an adhesive, such as an epoxy resin, or may be heat-sealed to the silicone case 20. However, the pads 16, 18 may also be formed as an intrinsic part of the silicone case 20. The card holder preferably has a waffle texture on the outer surface of the silicone case 20 to give added protection against slippage.

The top pad 16 and the bottom pad 18 are in electronic communication with each other. A conductive silicone line 22 is preferably located within the silicone case 20, electronically communicating the top pad 16 with the bottom pad 18, as shown in FIG. 1. However, other means for electronically communicating the top pad 16 and the bottom pad 18 are known in the art, such as metal wires or other electric conductors. The pads are situated so that a circuit is not completed when a card is located between them, and is completed when the card is removed.

Figure 2:
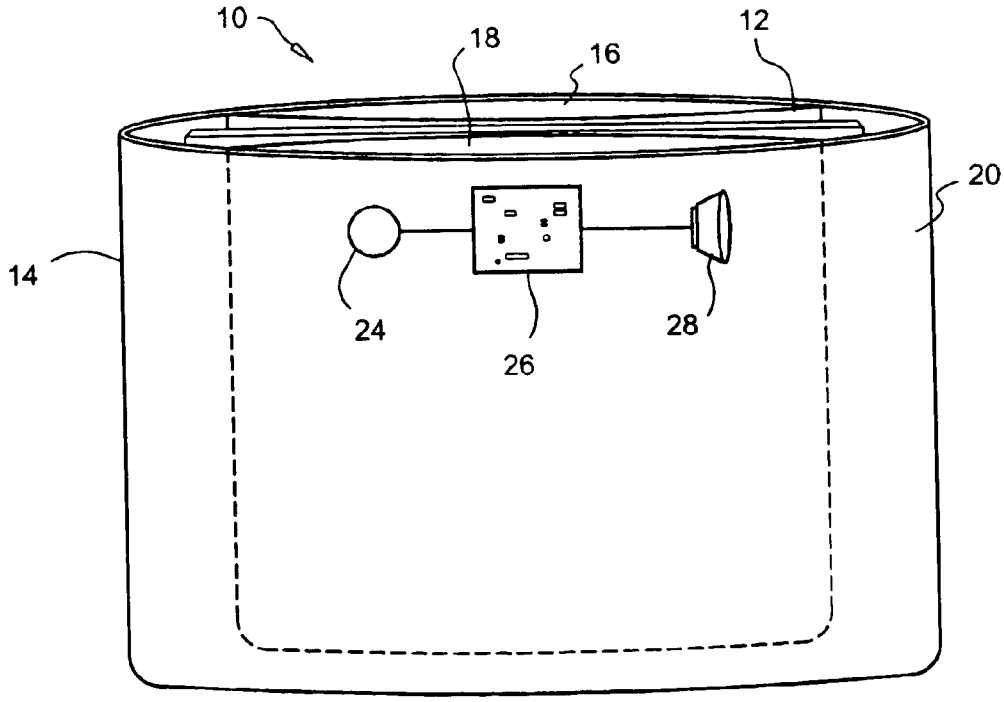
FIG. 2 is a side plan view of the preferred embodiment of the invention.

A power source is also in electronic communication with the contacts 16, 18. As shown in FIG. 2, the preferred power source is an electronic battery 24. The preferred battery is a 3 volt battery, such as the Rayovac model 2016 battery. However, other power sources may be used instead of a battery 24 or in conjunction with a battery 24. For example, a solar panel may placed on the exterior 14 of the apparatus 10 and used to power the apparatus or to charge the battery 24 used to power the apparatus 10. In addition, in the preferred embodiment, the battery 24 is placed on the apparatus 10 in a slit in the exterior 14 adapted for entry and proper placement of the battery 24. The battery 24 may be accessible through the case 20 so that the battery 24 may be replaced. However, it may alternatively be preferred that the battery 24 is encased within the case 20 so that the apparatus 10 is disposable when the battery 24 runs out.

The power source 24 is also in electronic communication with a miniature electronic circuit 26 which would sound an alarm when the contacts 16, 18 have been in electronic communication for a predetermined duration. In the preferred embodiment, the duration is approximately 1 minute. The circuit 26 provides for the resetting of the alarm function when the card is replaced within the recess 12. The circuit 26 is preferably programmed into one or more integrated circuit chips, however, other miniature electronic devices may also hold the circuit 26. The circuit is placed within the silicone case 20. The circuit 26 may be inserted within the case 20, or it alternatively may be placed within the case 20 as the case 20 is manufactured. In the preferred embodiment, the alarm would be a beeping signal. Other signals such as buzzers, messages or songs may be programmed into the circuit 26.

The alarm triggered by the circuit 26 is made audible by one or more small speakers 28 in electronic communication with the circuit 26. In the preferred embodiment, a single speaker is used, and the preferred model is a Sony Model No. 2045. However, other appropriate speakers 28 by other manufacturers are also known in the art. The speaker 28 is located at least partially within the silicone case 20, as shown in FIG. 2.

As described, the apparatus 10 does not draw power from the power supply until the contacts 16, 18 are in electronic cooperation. Thus, this apparatus 10 can be used for a substantial period of time without needing a change of power supply.

In an alternative embodiment, the apparatus 10 can be inserted in to a wallet of a man or woman for the special identification of the card to be used. The exterior surface 14 of the apparatus would thus have a non-slip surface which would prevent the cardholder, and thus the card, from accidentally falling out of the wallet when the wallet is opened. The apparatus may also be attached to a fanny pack, handbag, briefcase, or any other type of bag that might hold one or more credit cards or credit card sized identification.

Figure 3:
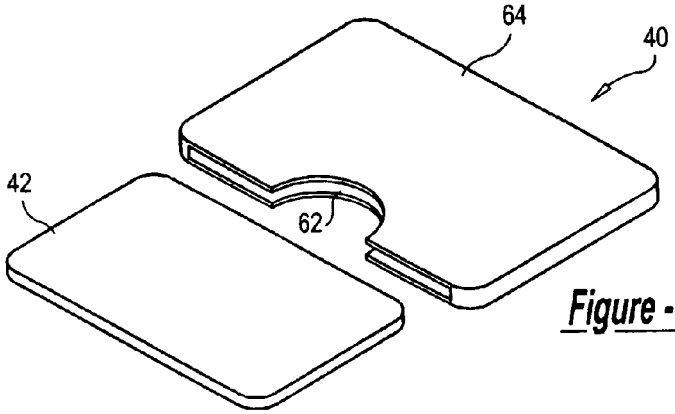
FIG. 3 is a perspective view of an alternate embodiment of the invention with the card removed.
Figure 4:
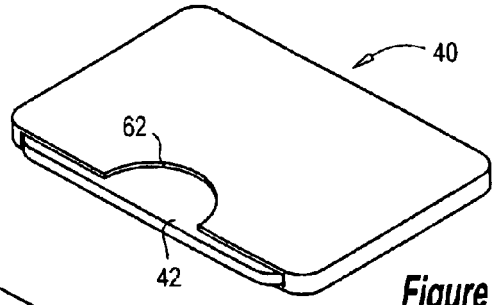
FIG. 4 is a perspective bottom view of an alternate embodiment of the invention with the card inserted.

Another alternate embodiment is shown in FIG. 3. As shown, the apparatus 40 is a thin, protective, easy to use card carrier capable of being inserted in the wallet. The card 42 fits within the apparatus 40 as shown in FIG. 4. In the preferred embodiment, the apparatus 10 is made of a rigid, non-conductive plastic material. It is preferred that the apparatus is 90 mm in length, 60 mm in width and 5.5 mm in height.

Figure 5:
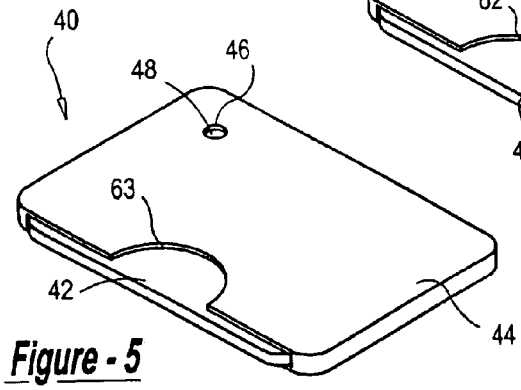
FIG. 5 is a perspective top view of an alternate embodiment with the card inserted.

As shown in FIG. 5, in the preferred embodiment, on the back side 44 of the apparatus 40 has at least one aperture 46 improving the sound characteristics for an alarm.

Figure 6:
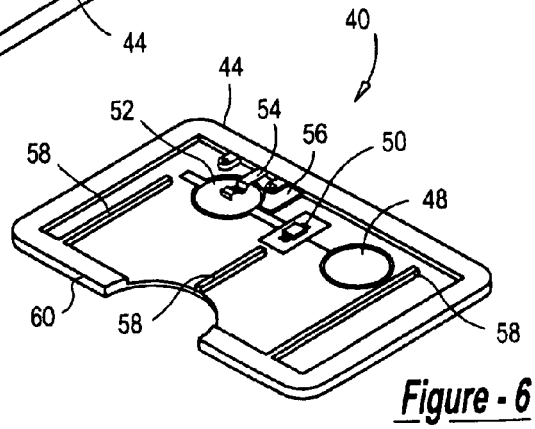
FIG. 6 is a perspective top view of the interior surface of the back portion of an alternate embodiment.

In FIG. 6, the interior surface of the back portion 44 of the card carrier 40 is revealed. As shown, the speaker 48 is located in a recess within the back portion 44. It is preferred that the speaker is soldered to the back portion 44 and the audio output lever is approximately 65 db. The power supply 52 is in electronic communication with a microprocessor 50. It is preferred that the power supply is a 3.0V battery located in a second recess within the back portion 44. The microprocessor 50 is a programmable interrupt controlled device as is known in the art. The microprocessor 50 is in electronic communication with a power supply 52. The microprocessor 50 is activated when power is supplied from the power supply 52. In the preferred embodiment contact is made between the microprocessor 50 and the power supply 52 through a leaf spring contact 54. The contact 54 is designed to connect with the power supply 52 when the card is removed from the card carrier 40. Thus, no power is supplied to the system while the card is within the carrier 40 and the alarm is activated after the card is removed.

Furthermore, the preferred embodiment includes a c-shaped guide 56 for the card. The c-shaped guide helps ensure that the card sits properly within the card carrier 40. As shown, the c-shaped guide 56 and the spring contact 54 are integrally constructed and attached to the back portion 44. In the preferred embodiment the c-shaped guide 56 and the leaf spring 54 are constructed of metal. However, they may be made of other material so long as the spring contact 54 is conductive and creates a circuit with the microprocessor 50.

A front portion 64 is attached fixedly to the back portion 44 to protect the card 44. The front can be attached frictionally, snapped on, or annealed, or other methods know in the art.

As also shown in FIG. 6, the interior of the card carrier 40 preferably includes one or more elongated guides 58 extending from the near portion 60 of the carrier 40. Preferably, the elongated guides 58 guide the card to proper orientation within the apparatus 40. In addition, the elongated guides 58 also served to protect the surface of the card within the apparatus 40. In the preferred embodiment, the elongated guides 58 are formed integrally with the back portion 44 of the apparatus 40. However, there may also be glued on or attached by other means known in the art. In addition, guides may be located on the interior of the front portion 64.

Also, it is preferred that the apparatus 40 has an indentation 62 as shown in FIGS. 3 through 5. The indentation 62 enables the user to easily insert or remove the card 42 from the carrier 40. Preferably, the indentation 62 is of a size which allows a person's fingers to tightly grip the card located inside the carrier 40.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A flexible non-bulky, metal-minimizing card holder for credit cards, debit cards and identification cards, including an alarm for identifying removal of a card from a holder after a predetermined duration using flexible contact points, comprising:

a holder adapted for a single card including a single recess adapted for holding a card;

flexible springing electrical contact means located in the single recess of the holder for triggering an alarm adapted to be held apart by the card placed in the holder interposed between the contact means, whereby any power source is disconnected until the means for triggering the alarm is activated;

an intrinsic power source in electronic communication with the contact means; and electronic means for providing an audible alarm after a predetermined delay after the removal of the card from the holder;

wherein the exterior of the card holder is a non-slip silicone case.

2. The card holder of claim 1, wherein the card holder is adapted for fitting in a wallet.

3. The card holder of claim 2, wherein the alarm means comprises a piezoelectric beeper.

4. The card holder of claim 2, wherein the power source is not in electronic communication with the contact means until the alarm has been triggered.

5. The card holder of claim 2, wherein the exterior of the card holder is translucent.

6. The card holder of claim 1, wherein the card holder is attached to the interior of a wallet.

7. The card holder of claim 1, wherein the exterior of the card holder is heat sealed to the electronic contact means.

8. The card holder of claim 1, wherein the exterior of the card holder is attached to the electronic contact means with an adhesive.

9. The card holder of claim 1, wherein the power source is inaccessible to the user.

10. An alarm system for a wallet or card holder for which an audible alarm sounds after a card has been removed for a predetermined period of time, comprising:

a rigid card holder including a single recess adapted for holding a card;

a single electrical contact means located in the recess of the holder for triggering an alarm adapted to be held apart by the card in the holder;

an intrinsic power source in electronic communication with the contact means, whereby any power source is disconnected until the means for triggering the alarm is activated;

electronic means for providing an audible alarm after a predetermined delay after the removal of the card from the holder; and a plurality of rigid elongated vertical guides for the card formed directly onto an interior surface of the holder.

11. A thin, easy-to-use, simple-to-manufacture card carrier capable of being inserted in a wallet, comprising:

means for securely holding a card adapted for holding a single card having a plurality of rigid elongated vertical guides for the card formed directly onto an interior surface of the holder; and electronic means for activating an alarm when the card is removed from the carrier for a predetermined amount of time located within the means for holding a card having a single flexible contact, whereby any power source for the card carrier is disconnected until the means for activating an alarm is activated.

12. The card carrier of claim 11, further comprising means located on the interior surface of the card carrier for protecting the surface of the card.

13. The card carrier of claim 11, further comprising elongated means for guiding the card toward proper placement within the card carrier.

14. The card carrier of claim 11, further comprising indented means for easily gripping and removing the card while inside the carrier located at a near end of the carrier.

15. The card carrier of claim 14, wherein the indented means are complementary to the size of a users' fingers.

16. The card carrier of claim 11, wherein the carrier is formed by the joining of two separately manufactured pieces.

17. The card carrier of claim 11, wherein the electronic means comprises:

a means for securing the card within the carrier, whereby removal of the card from the means for securing the card activates the alarm after a pre-determined delay.

18. The card carrier of claim 17, wherein the electronic means further comprises a metal spring attached to an inside surface of the carrier.

19. The card carrier of claim 18, further including elongated guiding means for the card.

20. The card carrier of claim 11, wherein the means for securely holding the card comprises a front portion comprising the electronic means for activating the alarm.

21. An alarm system for detecting the removal of a card from a card holder, comprising:

a rigid protective structure for at least partly enclosing a card;

a card securing mechanism fixedly attached to the interior of the protective structure having a plurality of elongated guides formed on an interior surface of the protective structure; and an alarm activating structure located at an interior portion of the protective structure in electronic communication with the card securing mechanism having a single flexible contact, whereby the alarm activating structure activates an alarm after a pre-determined delay from the time the card is removed from the protective structure, and whereby any power source for the card carrier is disconnected until the means for activating an alarm is activated.

22. The alarm system of claim 21, wherein the card securing mechanism includes a leaf spring, whereby contact between the card and the leaf spring prevents the activation of the alarm.

23. The alarm system of claim 22, wherein the card securing mechanism further comprises a C-shaped guide for the card.

24. The alarm system of claim 23, wherein the leaf spring and the C-shaped guide are fixedly attached to one side of an interior portion of the protective structure.

* * * * *